US011674516B1

(12) United States Patent
McPherson

(10) Patent No.: US 11,674,516 B1
(45) Date of Patent: Jun. 13, 2023

(54) ELECTRIC PRIMING PUMP DEVICE

(71) Applicant: Joshua J. McPherson, Midland, OR (US)

(72) Inventor: Joshua J. McPherson, Midland, OR (US)

( * ) Notice: Subject to any disclaimer, the term of this patent is extended or adjusted under 35 U.S.C. 154(b) by 9 days.

(21) Appl. No.: 17/575,468

(22) Filed: Jan. 13, 2022

Related U.S. Application Data

(60) Provisional application No. 63/193,811, filed on May 27, 2021.

(51) Int. Cl.

| | |
|---|---|
| ***F04D 9/04*** | (2006.01) |
| ***F04D 15/00*** | (2006.01) |
| ***F04D 1/00*** | (2006.01) |
| ***F04D 13/06*** | (2006.01) |
| ***F04C 25/02*** | (2006.01) |
| ***F04C 27/02*** | (2006.01) |
| ***F04C 18/344*** | (2006.01) |
| ***F04C 23/00*** | (2006.01) |
| ***F04B 53/00*** | (2006.01) |
| ***F04B 17/06*** | (2006.01) |
| ***F04B 35/06*** | (2006.01) |

(52) U.S. Cl.
CPC ..... *F04D 9/04* (2013.01); *F04B 17/06* (2013.01); *F04B 35/06* (2013.01); *F04B 53/00* (2013.01); *F04C 18/3441* (2013.01); *F04C 23/00* (2013.01); *F04C 25/02* (2013.01); *F04C 27/02* (2013.01); *F04D 1/00* (2013.01); *F04D 9/041* (2013.01); *F04D 9/042* (2013.01); *F04D 13/06* (2013.01); *F04D 15/0005* (2013.01)

(58) Field of Classification Search
CPC . F04D 9/041; F04D 9/042; F04D 9/04; F04D 1/00; F04D 13/06; F04D 15/0005; F04C 23/00; F04C 27/02; F04C 18/3441; F04C 25/02; F04B 53/00; F04B 17/06; F04B 35/06
See application file for complete search history.

(56) References Cited

U.S. PATENT DOCUMENTS

| | | | | |
|---|---|---|---|---|
| 1,890,125 | A * | 12/1932 | Moore | F04D 9/001 417/200 |
| 1,995,812 | A * | 3/1935 | Noble | F04D 9/048 417/202 |
| 2,033,980 | A | 3/1936 | Durdin, Jr. | |
| 2,275,502 | A | 3/1942 | Broadhurst | |
| 4,067,663 | A * | 1/1978 | Brooks | F04D 9/045 417/199.2 |

(Continued)

*Primary Examiner* — Peter J Bertheaud
(74) *Attorney, Agent, or Firm* — Jerry Haynes Law

(57) ABSTRACT

An electric priming pump device detachably couples to a centrifugal water pump on the suction side of the water pump, for priming thereof. The device comprises an enclosure and a base, wherein the enclosure contains a rotary vane peripheral bypass vacuum motor which is pressed against the base to form an air-tight seal. The device generates a vacuum for priming through use of a rotary vane peripheral bypass vacuum motor, which can remove large volumes of air quickly. An opening in the base receives a check valve fitting to protect the motor from water and slows loss of vacuum pressure after use. Additionally, a cone shaped protective cover protects components in the device and provides space for branding or advertisement.

9 Claims, 3 Drawing Sheets

(56) References Cited

U.S. PATENT DOCUMENTS 5,209,653 A * 5/1993 Murray ..... F04C 28/28
417/435
5,465,455 A * 11/1995 Allen ..... A47L 7/0028
15/353
7,331,769 B2 * 2/2008 Weis ..... F04D 9/04
417/199.2

* cited by examiner

ELECTRIC PRIMING PUMP DEVICE

CROSS-REFERENCE TO RELATED APPLICATIONS

This application claims priority from U.S. Provisional Application Ser. No. 63/193,811, entitled "Electric Priming Pump Device", filed on May 27, 2021, which application is hereby incorporated herein by reference in its entirety.

FIELD OF THE INVENTION

The present invention relates generally to a priming system for centrifugal pumps. More so, the present invention relates to a portable electric priming pump for priming centrifugal pumps.

BACKGROUND OF THE INVENTION

Generally, the process of filling a pump with liquid is called priming. The main objective of priming a pump is to remove the gas present as the pump impeller becomes gas-bound and incapable of pumping water or liquid. So, if there is air or other gases present inside the pump casing and suction line, the pump must be primed before starting. The energy impact on air is much less; the impeller cannot transmit enough energy thru air to lift water to run the pump so priming is required for of centrifugal pumps. But if the pump suction line and the casing are already filled with liquid during start-up, priming is not required. Normally, centrifugal pumps need priming and positive displacement pumps (rotary pumps, reciprocating pumps) do not require priming as they push all the air by itself because they have suction and delivery valves to displace "fluid" positively. But for first-time operation, all pumps need priming to avoid overheating and resulting in failure from dry running conditions.

For manual pump priming, liquid is filled in the pump suction by manually pouring liquid directly in suction using a funnel. The pump is manually primed via gravity feed and the air present escapes through the air vent valve. But this process can be time consuming.

Numerous attempts have been made and several prior art devices are known for priming pump devices. Even though these innovations may be suitable for the specific purposes to which they address, however, they would not be as suitable for the purposes of the present invention.

For example, U.S. Pat. No. 2,275,502 to Broadhurst discloses a centrifugal pump comprising a means fixedly mounted to the suction side of the pump for evacuating gas to raise liquid therein to a level above the intake passage to prime the pump, however the system is not portable and is very bulky, further visual identification of the priming condition is not disclosed.

For example, U.S. Pat. No. 2,033,980 to Durdin Jr. describes a priming pump comprising a float type valve that is intended to close the vacuum orifice to prevent water from being taken into the vacuum pump, It fails to disclose a portable priming pump that has steel ball to auto shut off the valve after priming however, as well as it fails to disclose visual identification of the priming condition during priming of the centrifugal pump.

It is apparent now that numerous innovations that are adapted to a variety of priming pump systems or devices have been developed in the prior art that are adequate for various purposes. Furthermore, even though these innovations may be suitable for the specific purposes to which they address, accordingly, they would not be suitable for the purposes of the present invention as heretofore described. Thus, a portable electric priming pump for priming centrifugal pumps as disclosed in the present invention is needed.

SUMMARY OF THE INVENTION

The present invention relates generally to an electric priming pump device that detachably couples to a centrifugal water pump on the suction side of the water pump, for priming thereof.

According to one aspect of the present invention, a portable electric priming pump device for priming a centrifugal water pump; whereby the priming source is a rotary vane peripheral bypass vacuum motor; whereby visual confirmation of priming is via a clear hose or pipe; and whereby a check valve comprises a metal or heavy ball, providing multiple advantages during priming.

According to another aspect of the present invention, the device comprises an enclosure that attaches the vacuum motor to the base and creates an air-tight seal between the motor and the base. The base is configured to set inside the enclosure. The enclosure contains a rotary vane peripheral bypass vacuum motor pressed against the base to form an air-tight seal with aid of a gasket. The device generates a vacuum for priming through use of a rotary vane peripheral bypass vacuum motor, which can remove large volumes of air quickly. An opening in the base receives a check valve fitting to protect the motor from water and slows loss of vacuum pressure after use. A metal ball such as a steel ball is used inside the check valve fitting. The enclosure is also configured with outlets that help vent exhaust gases and heat from the vacuum motor. Additionally, a cone shaped protective cover protects components in the device and provides space for branding or advertisement.

One objective of the present invention is to provide a portable electric priming pump device to prime a centrifugal water pump from the suction side.

One objective of the present invention is to provide a portable electric priming pump that can be detachably attached suction side of any water pump for priming thereof.

Another objective is to generate the vacuum with a rotary vane peripheral bypass vacuum motor, which can remove large volumes of air quickly.

Yet another objective is to use a steel ball that drops when the vacuum motor is powered off, so as to limit vacuum loss while the operator closes the priming valve and turns off the priming pump.

Yet another objective is to use a steel ball that restrains pressurized water that is being pushed into the vacuum motor, should the priming pump be installed on the volute of the centrifugal motor and the operator fail to close their priming valve.

Yet another objective is providing an inexpensive priming solution for irrigation pumps that have motors greater than 10 HP.

These and other objectives, advantages and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting unless the claims expressly state otherwise.

Figure 1:
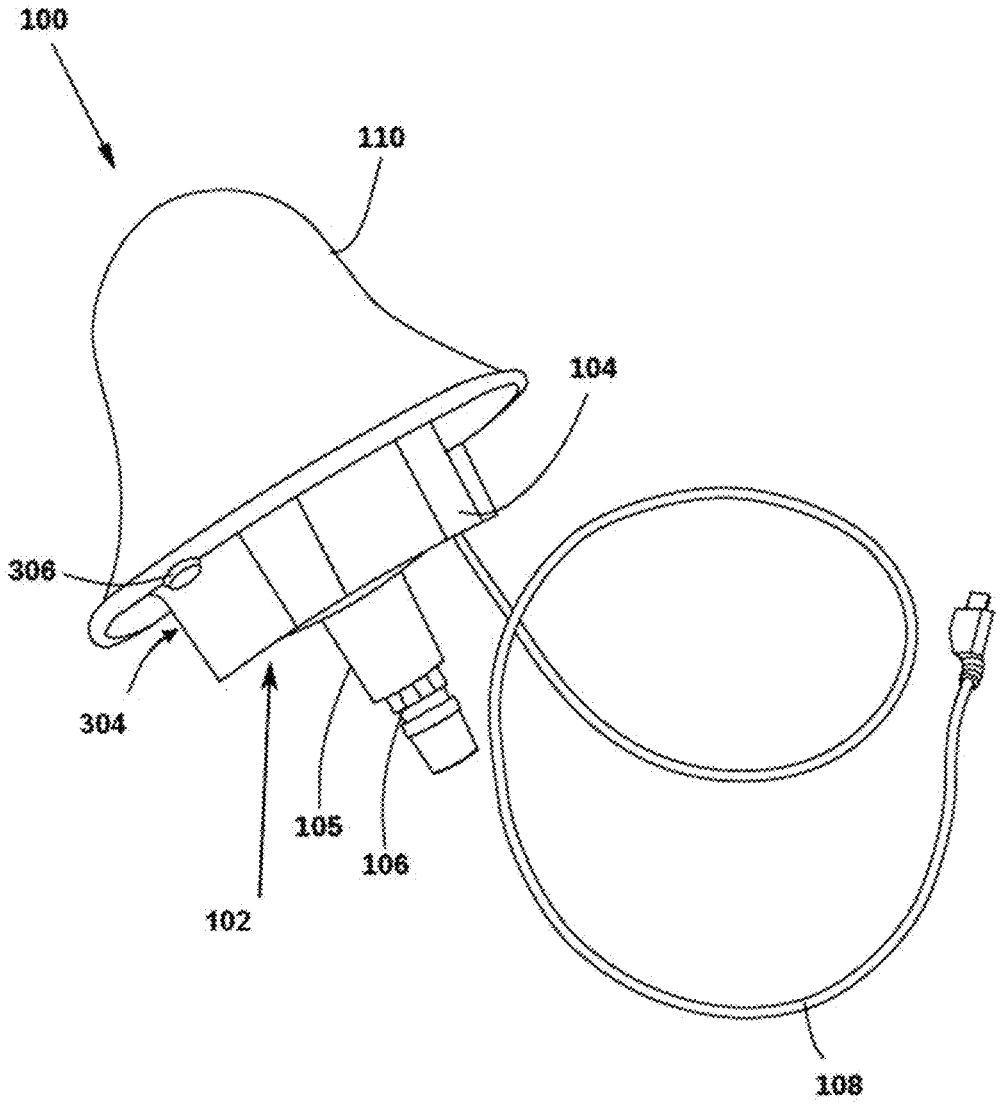
FIG. 1 illustrates a perspective view of an exemplary portable electric priming pump device, in accordance with an embodiment of the present invention.
Figure 2:
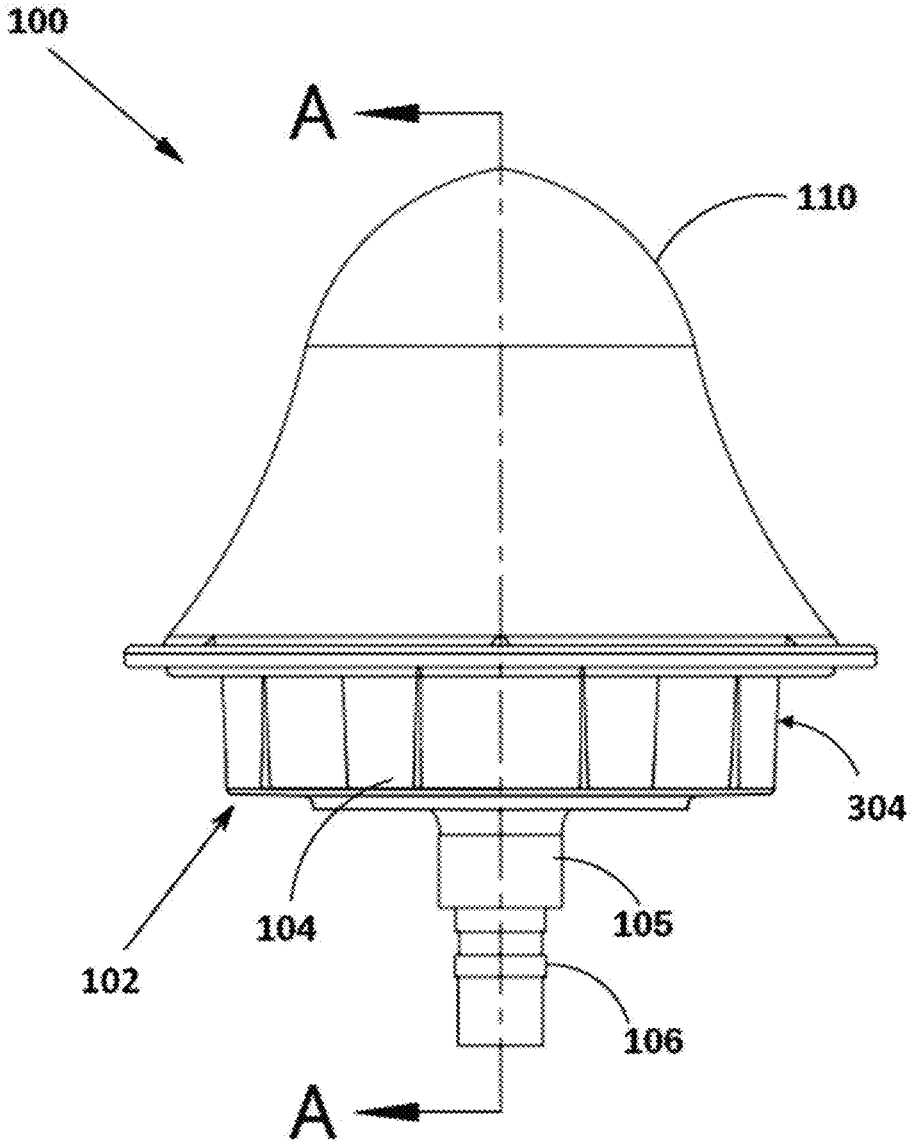
FIG. 2 illustrates a side view of the portable electric priming pump device shown in FIG. 1, in accordance with an embodiment of the present invention.
Figure 3:
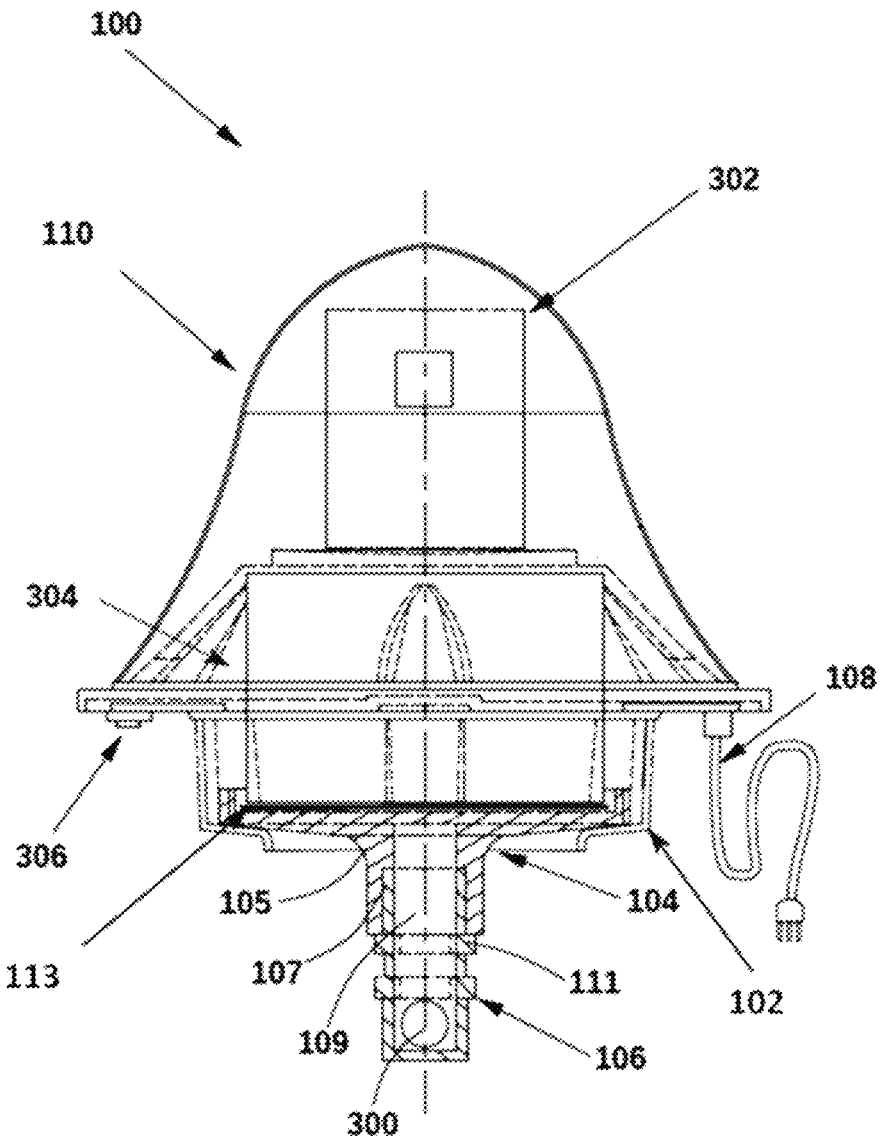
FIG. 3 illustrates a sectioned side view of the electric priming pump device, the section taken along section A-A of FIG. 2, detailing the enclosure containing the vacuum motor, and a metal ball in the check valve fitting, in accordance with an embodiment of the present invention.

An electric priming pump device 100 is referenced in FIGS. 1-3. The electric priming pump device 100, hereafter "device 100" is configured to detachably couple to a centrifugal water pump on the suction side of the water pump, for priming thereof. The device 100 utilizes a unique arrangement of mechanical components to evacuate air from the water pump and a suction line thereof.

In one possible embodiment, the device 100 comprises an enclosure 304 having a bottom surface 102, wherein the enclosure 304 forms a protective cover for components of the device 100. A base 104 is configured to join with the bottom surface 102 of the enclosure 304. The enclosure 304 contains a rotary vane peripheral bypass vacuum motor 302, which is an electric vacuum motor 302 that is commercially available. The electric vacuum motor 302 within the enclosure 304 is secured to the base 104 to form an air-tight seal. An opening in the base 104 receives a check valve fitting 106 to protect the motor from water and slows or eliminates loss of vacuum pressure after use. A heavy ball such as a ceramic ball or a metal ball like a steel ball 300 is used inside the check valve fitting 106. The enclosure 304 is also configured with outlets that help allow air to enter into the device 100 to cool and vent exhaust from the vacuum motor 302. Additionally, the device 100 provides a motor cover 110 to protect the motor. In one exemplary embodiment, the motor cover 110 is conical or shape of a mushroom head in shape, though other shape and design can be used without departing from the scope and spirit of the present invention.

According to another embodiment of the present invention, the device 100 generates a vacuum for priming through use of a rotary vane peripheral bypass vacuum motor 302, which can remove large volumes of air quickly. This can be useful for priming centrifugal water pumps that need a large volume of air to be removed in order to prime. Additionally, the device 100 enables visual confirmation of priming via a clear hose or pipe (not shown).

Yet according to another embodiment of the present invention, a check valve 106 at the neck of the device 100 comprises a steel ball 300. Use of a steel ball 300 provides multiple advantages during priming, including: 1) the steel ball drops under gravitational force when the vacuum motor 302 is powered off, so as to limit vacuum loss while the operator closes the priming valve and turns off the priming pump; and 2) restrain pressurized water that is being pushed into the vacuum motor 302, should the priming pump be installed on the volute of the centrifugal motor and the operator fails to close their priming valve, whereby this helps prevent damage to the rotary vane peripheral bypass vacuum motor 302.

According to one aspect of the present invention, a portable electric priming pump device 100 shown in FIG. 1, comprises: an enclosure 304 having a bottom surface 102, wherein the enclosure 304 forms a protective cover for components of the device 100; a base 104, wherein the base 104 is set inside the bottom surface 102 of the enclosure 304; a vacuum motor 302, wherein the vacuum motor 302 is operably mounted inside the enclosure 304 to form an air-tight seal with the base 104 with the aid of a gasket 113, further the vacuum motor 302 is protected by a motor cover 110 with vents; the base 104 comprising a coupling neck 105, the coupling neck 105 defined by a neck opening 107 (shown in FIG. 3); a check valve fitting 106 insertable into the neck opening 107, the check valve fitting 106 defining a channel 109; an steel ball 300 disposed inside the channel 109 of the check valve fitting 106, the steel ball 300 operable to move along the channel 109 in response to the generated vacuum by the vacuum motor 302, whereby when no vacuum is generated by the vacuum motor 302, the steel ball 300 occupies the neck opening 107; and a transparent suction hose (not shown) operable to couple the check valve fitting 106 to a centrifugal water pump (not shown), whereby the transparent suction hose couples to the suction side of the centrifugal water pump.

In another aspect, as shown in FIG. 1-3 a portable electric priming pump device 100, the device 100 comprising: an enclosure 304; a base 104, wherein the base 104 comprising a coupling neck 105 defined by a neck opening 107; a vacuum motor 302 operably mounted inside the enclosure 304 to form an air-tight seal with the base 104, a check valve fitting 106 insertable into the neck opening 107, wherein the check valve fitting 106 defining a channel 109 and a ball 300 disposed inside the channel 109, the ball 300 is configured to move along the channel 109 in response to the vacuum pressure generated by the vacuum motor 302, whereby when no vacuum is generated by the vacuum motor 302, the ball 300 falls under gravity and closes the neck opening 107; and a transparent suction hose (not shown), wherein one end of the transparent hose is configured to couple the check valve fitting 106 and the other end of the transparent hose is configured to couple to suction side of a water pump (not shown), thereby enabling visual confirmation of priming of the water pump.

In another aspect, as shown in FIG. 1-3 a portable electric priming pump device 100, the device 100 comprising: an enclosure 304 having a bottom surface 102; a base 104 set inside the bottom surface 102 of the enclosure 304, further the base 104 comprising a coupling neck 105 defined by a neck opening 107; a vacuum motor 302, wherein the vacuum motor 302 is operably mounted inside the enclosure 304 to form and air-tight seal with the base 104 with the aid of the gasket 113, further the vacuum motor 302 is protected by a motor cover 110 with vents (not shown); a check valve fitting 106 insertable into the neck opening 107, the check valve fitting 106 defining a channel 109; a steel ball 300 disposed inside the channel 109 of the check valve fitting 106, wherein the steel ball 300 is configured to move along the channel 109 of the check valve fitting 106 in response to the vacuum pressure generated by the vacuum motor 302 to protect the vacuum motor 302 from exposure to water, whereby when no vacuum is generated by the vacuum motor 302, the steel ball 300 falls under gravity and closes the neck opening 107; a power source (not shown) actuated by a control switch 306 and operatively connected to the vacuum motor 302; and a transparent suction hose (not shown), wherein one end of the transparent hose is configured to couple the check valve fitting 106 and the other end of the transparent hose is configured to couple to suction side of a centrifugal water pump (not shown), thereby enabling visual confirmation of priming of the centrifugal water pump and automatically closing check valve 106 to trap the water in the water pump.

In another aspect, the power source (not shown) is an electrical power source in the form of AC power source, battery powered, solar cell or the like.

In another aspect, the device 100 further comprises a power cord 108 operatively connected to the motor 302.

In another aspect, the device 100 further comprises a power switch 306 operatively connected to the vacuum motor 302.

In another aspect, the motor cover 110 has a cone shape, though other shape and design of the cover 110 can be used without departing from the scope and spirit of the present invention.

In another aspect, the vacuum motor 302 comprises a rotary vane peripheral bypass vacuum motor 302.

In another aspect, the portable electric priming pump device 100 is configured to allow any water accumulated in the enclosure 304 to drain out.

In another aspect, the portable electric priming pump device 100 is used to prime a centrifugal water pump from the suction side to generate the vacuum with a rotary vane peripheral bypass vacuum motor 302 that can remove large volumes of air quickly.

In another aspect, the ball 300 disposed inside the check valve fitting is a heavy ball that can freely fall under gravity when there is no vacuum pressure generated by the vacuum motor 302, the ball 300 is a ceramic ball, glass ball, metal ball such as a steel ball or any such heavy ball that falls under gravity and closes the neck opening 107 when the vacuum motor 302 is powered off, so as to limit vacuum loss while the operator closes the priming valve and turns off the priming pump 100. Further the ball 300 restrains pressurized water that is being pushed into the vacuum motor 302, should the priming pump be installed on the volute of the centrifugal motor 302 and the operator fail to close the priming valve.

In another aspect, the priming pump device 100 of the present invention is an inexpensive priming solution for irrigation pumps that have motors greater than 10 HP, though it is not limiting the scope and spirit of the present invention.

As FIG. 2 references, the device 100 comprises an enclosure 304 defined by an open bottom surface 102. Inside the enclosure 304 a vacuum motor 302 is mounted, wherein the vacuum motor 302 is configured to generate a vacuum inside the coupling neck 105 of the base 104. In one non-limiting embodiment, the vacuum motor 302 comprises a rotary vane peripheral bypass vacuum motor 302. Such a vacuum motor 302 provides advantages, such as being better suited to irrigation systems which have lower lift requirements and can have large suctions. Such a vacuum motor 302 provides a solution over priming pumps that need a large volume of air to be removed in order to prime the system.

In some embodiments, the device 100 further comprises a power cord 108 operatively connected to the vacuum motor 302. The power cord 108 may be configured to couple to an A/C power source, or a D/C power source. In other embodiments, the device 100 comprises a power switch that is operatively connected to the vacuum motor 302. The power switch 306 may include an "On"-"Off" switch 306, as shown in FIG. 3.

In some embodiments, a base 104 is configured to set inside the bottom surface 102 of the enclosure 304. The base 104 has a flat surface with a flange perimeter that is secured within the bottom surface 102 with the help of a flat gasket 113 to air tightly secure the vacuum motor 302 to the base 104, wherein the gasket 113 is configured to match with the sealing area between the motor 302 and the base 104. Various fasteners may be used to fasten the bottom surface 102 and the base 104. In one possible embodiment, the base 104 comprises a coupling neck that extends from one end of the base 104. The coupling neck defines a neck opening that forms an elongated channel (See FIG. 2).

In some embodiments, a check valve fitting 106 is fitted into the coupling neck 105. The check valve fitting 106 defines a neck opening 107. In one non-limiting embodiment, a small gasket 111 can be used inside the neck fitting 107 to create an air-tight seal for vacuum generation. In some embodiments, a steel ball 300 disposed inside the channel 109 of the check valve fitting 106, the steel ball 300 operable to move along the channel 109 in response to the generated vacuum, whereby when no vacuum is generated by the vacuum motor 302, the steel ball 300 occupies the neck opening 107.

Looking again at FIG. 3, the use of a steel ball 300 for a check valve 106 serves two functions. The steel ball 300 drops when the vacuum motor 302 is powered off, so as to limit vacuum loss while the operator closes the priming valve and turns off the priming pump. In other embodiments, the steel ball 300 helps restrain pressurized water into the vacuum motor 302. This is the case when the device 100 is installed on the volute of the centrifugal motor, and the operator fail to close their priming valve, so as to prevent damage to the vacuum motor 302.

In order to suck the air from the water pump, the device 100 utilizes a transparent suction hose (not shown). The suction hose is configured to couple the check valve fitting 106 to a centrifugal water pump (not shown). In one embodiment, the transparent suction hose couples to the suction side of the centrifugal water pump. Because of the transparency of the hose, the device 100 does not utilize electric controls to determine operation of the vacuum. Rather, visual confirmation of priming via the clear hose is possible. The negative pressure in the suction is visibly confirmed for priming and automatically closing valves to trap the water in the water pump. Such visible configuration of the vacuum operating makes the device 100 more usable and dependable for use.

The device 100 is a labor-saving invention. This is because most centrifugal pumps are primed with a hand-operated primer to remove air from the pump before use. This can take several minutes of hard labor if the pump and the intake are large. More efficiently, the device 100 is able to prime most systems in under a minute with the flip of a switch. Further, the device 100 uses high volume vacuum motors typically found in car washes and central vacuum systems. This is designed to be a labor-saving analogue to existing hand primers that is simple and easy to use.

Because many modifications, variations, and changes in detail can be made to the described preferred embodiments of the invention, it is intended that all matters in the above description and shown in the accompanying drawings be interpreted as illustrative and not in a limiting sense. Thus, the scope of the invention should be determined by the appended claims and their legal equivalence.

What is claimed is:

1. A portable electric priming pump device, the device comprising:

an enclosure, a base, wherein the base comprising a coupling neck defined by a neck opening;

a vacuum pump powered by a vacuum motor, the vacuum pump operably mounted inside the enclosure to form an air-tight seal with the base, a check valve fitting insertable into the neck opening, wherein the check valve fitting defines a channel and a ball disposed inside the channel, the ball is configured to move along the channel in response to the vacuum pressure generated by the vacuum pump, whereby when no vacuum is generated by the vacuum pump, the ball falls due to gravity and closes the neck opening; and a transparent suction hose, wherein one end of the transparent hose is configured to couple the check valve fitting and the other end of the transparent hose is configured to couple to suction side of a water pump, thereby enabling visual confirmation of priming of the water pump.

2. The device of claim 1, wherein the vacuum pump comprises a rotary vane peripheral bypass vacuum motor.

3. The device of claim 1, wherein the ball disposed inside the channel of the check valve fitting is selected from the group consisting of an anticorrosive metal ball, a glass ball, and a ceramic ball.

4. The device of claim 1, wherein the vacuum pump is protected by a pump cover with vents.

5. The device of claim 1, further comprising a power source actuated by a control switch and operatively connected to the motor.

6. A portable electric priming pump device, the device comprising:

an enclosure, wherein the enclosure comprising a bottom surface;

a base, wherein the base is set inside the bottom surface of the enclosure, further the base comprising a coupling neck defined by a neck opening;

a vacuum pump powered by a vacuum motor, wherein the vacuum pump is operably mounted inside the enclosure to form an air-tight seal with the base, further the vacuum pump is protected by a motor cover with vents;

a check valve fitting insertable into the neck opening, the check valve fitting defining a channel;

an anticorrosive metal ball disposed inside the channel of the check valve fitting, wherein the metal ball is configured to move along the channel of the check valve fitting in response to the vacuum pressure generated by the vacuum pump to protect the vacuum pump from water, whereby when no vacuum is generated by the vacuum pump, the ball falls under gravity and closes the neck opening;

a power source actuated by a control switch and operatively connected to the vacuum pump; and a transparent suction hose, wherein one end of the transparent hose is configured to couple to the check valve fitting and the other end of the transparent hose is configured to couple to a suction side of a centrifugal water pump, thereby enabling visual confirmation of priming of the centrifugal water pump and automatically closing check valve to trap the water in the water pump.

7. The device of claim 6, wherein the vacuum pump comprises a rotary vane peripheral bypass vacuum motor.

8. The device of claim 6, wherein the pump cover has a cone shape.

9. The device of claim 6, wherein the anticorrosive metal ball is selected from the group consisting of a steel ball, a glass ball, and a ceramic ball.

* * * * *